US007458789B2

(12) United States Patent
Hiwata et al.

(10) Patent No.: US 7,458,789 B2
(45) Date of Patent: Dec. 2, 2008

(54) SCROLL COMPRESSOR

(75) Inventors: Akira Hiwata, Kyoto (JP); Takashi Morimoto, Kyoto (JP); Yoshiyuki Futagami, Shiga (JP); Noboru Iida, Shiga (JP); Kiyoshi Sawai, Shiga (JP)

(73) Assignee: Matsushita Electric Industrial Co., Ltd., Kodoma-Shi (JP)

( * ) Notice: Subject to any disclaimer, the term of this patent is extended or adjusted under 35 U.S.C. 154(b) by 250 days.

(21) Appl. No.: 10/560,365

(22) PCT Filed: Jun. 9, 2004

(86) PCT No.: PCT/JP2004/008378

§ 371 (c)(1),
(2), (4) Date: May 11, 2006

(87) PCT Pub. No.: WO2004/111462

PCT Pub. Date: Dec. 23, 2004

(65) Prior Publication Data

US 2007/0201997 A1 Aug. 30, 2007

(30) Foreign Application Priority Data

Jun. 12, 2003 (JP) ..... 2003-167400

(51) Int. Cl.
*F04C 18/04* (2006.01)

(52) U.S. Cl. ..... 418/55.6; 418/91; 418/100

(58) Field of Classification Search ..... 418/55.1, 418/55.2, 55.5, 55.6, 57, 83, 87, 91, 100
See application file for complete search history.

(56) References Cited

U.S. PATENT DOCUMENTS

| | | | | |
|---|---|---|---|---|
| 4,648,814 | A * | 3/1987 | Shiibayashi | 418/55.6 |
| 5,174,740 | A * | 12/1992 | Jang | 418/55.6 |
| 5,252,046 | A * | 10/1993 | Wen-Ding et al. | 418/55.5 |
| 5,855,475 | A * | 1/1999 | Fujio et al. | 418/55.1 |
| 6,302,665 | B1 * | 10/2001 | Esumi et al. | 418/178 |
| 6,827,563 | B2 * | 12/2004 | Hiwata et al. | 418/55.6 |
| 6,935,852 | B2 * | 8/2005 | Iida et al. | 418/55.5 |
| 2002/0134101 | A1 * | 9/2002 | Gennami et al. | 62/469 |

FOREIGN PATENT DOCUMENTS

| | | | |
|---|---|---|---|
| JP | 5-187369 | | 7/1993 |
| JP | 05187369 | A * | 7/1993 |
| JP | 2002-310076 | | 10/2002 |
| JP | 2002310076 | A * | 10/2002 |
| JP | 2004-44582 | | 2/2004 |

OTHER PUBLICATIONS

Chinese Office Action dated Aug. 24, 2007 with English translation.

* cited by examiner

*Primary Examiner*—Thomas Denion
*Assistant Examiner*—Mary A Davis
(74) *Attorney, Agent, or Firm*—Kratz, Quintos & Hanson, LLP.

(57) ABSTRACT

According to the present invention, an oil supply passage is formed in a suction space of a fixed scroll part, and an oil collision part is provided in the suction space. The oil collision part is provided in the suction space, an amount of oil to be supplied is controlled, refrigerant and lubricant oil are sufficiently mixed with each other. Tangents of ends of the oil collision part are made acute angle to smoothen the flow of the refrigerant.

26 Claims, 5 Drawing Sheets

SCROLL COMPRESSOR

TECHNICAL FIELD

The present invention relates to a scroll compressor in which a fixed scroll part and an orbiting scroll part are meshed with each other to form a compression chamber, the orbiting scroll part is allowed to orbit to carry out suction, compression and discharge while continuously changing a capacity of the compression chamber.

BACKGROUND TECHNIQUE

As a refrigeration or air conditioning hermetic compressor, there are conventional reciprocating type, rotary type and scroll type compressors, and these compressors are used in refrigeration or air conditioning fields of domestic or business purpose. Currently, compressors are developed while utilizing characteristics in terms of costs and performance.

Among them, a so-called hermetical compressor for preventing noise and eliminating the need of maintenance is a typical compressor in which a compressor mechanism and a motor are accommodated in a container, and a scroll compressor and a rotary compressor are in the mainstream. Generally, in the scroll compressor, a fixed scroll part in which a scroll lap rises from a mirror plate and an orbiting scroll part are meshed with each other to form a compression chamber therebetween, when the orbiting scroll part is allowed to orbit in a circular orbit while restraining the orbiting scroll part from rotating by a rotation-restraint mechanism, a compression chamber moves while changing its capacity, thereby carrying out the suction, compression and discharge, a predetermined back pressure is applied to an outer periphery of the orbiting scroll part and a back surface of a scroll lap by lubricant oil, so that the orbiting scroll part is not separated from the fixed scroll part and does not flip over.

According to the conventional scroll compressor, as shown in FIG. 4, a fixed scroll part 2 has a scroll lap 2*a* rising from a mirror plate 2*b*, and an orbiting scroll part 4 has a scroll lap 4*a* rising from a mirror plate 4*b*. The fixed scroll part 2 and the orbiting scroll part 4 are meshed with each other to form a compression chamber 5 therebetween. When the orbiting scroll part 4 is allowed to orbit in a circular orbit while restraining the orbiting scroll part 4 from rotating by a rotation-restraint mechanism 22, the compression chamber 5 moves while varying its capacity, thereby carrying out suction, compression and discharge.

That is, refrigerant gas sucked from a suction pipe 1 passes through a suction space 3 of the fixed scroll part 2 comprising the lap 2*a* and the mirror plate 2*b*, the refrigerant gas is enclosed in the compression chamber 5 formed by meshing the fixed scroll part 2 and the orbiting scroll part 4 comprising the lap 4*a* and the mirror plate 4*b* with each other, the refrigerant gas is compressed toward a center of the compression chamber 5 and is discharged from a discharge port 6.

A back pressure chamber 8 is formed such as to be surrounded by the fixed scroll part 2 and a bearing member 7. The back pressure chamber 8 always has back pressure for pushing the orbiting scroll part 4 against the fixed scroll part 2. A back pressure adjusting mechanism 9 is provided as means for always maintaining the back pressure at a constant level.

The back pressure adjusting mechanism 9 has a communication passage 10 which is in communication with the suction space 3 from the back pressure chamber 8 through the fixed scroll part 2. The communication passage 10 is provided with a valve 11. When the pressure in the back pressure chamber 8 becomes higher than a set pressure, the valve 11 is opened, lubricant oil in the back pressure chamber 8 is supplied to the suction space 3, and the pressure in the back pressure chamber 8 is maintained at a constant intermediate pressure.

On the other hand, lubricant oil accumulated in an oil reservoir 29 is introduced into an upper end of a shaft 13 through a passage 23 in the shaft 13 by an oil pump 31. The lubricant oil introduced into the upper end lubricates a sliding surface 33 and a sliding surface 34. A portion of the lubricant oil passes through a passage 24 in the orbiting scroll part 4, and is decompressed in a narrowed portion 12 and supplied to the back pressure chamber 8. The lubricant oil supplied to the suction space 3 is supplied to the compression chamber 5 together with the orbiting motion of the orbiting scroll part, and prevents refrigerant from leaking from the compression chamber 5, thereby enhancing the compression efficiency.

That is, the compression efficiency is enhanced by sealing using the lubricant oil. In a scroll compressor described in patent document 1 (Japanese Patent Application Laid-open No. 2000-110748), an involute winding end of the fixed scroll part is located directly above the discharge port, a suction port is formed in the vicinity of a suction passage so that the suction resistance of the scroll compressor is reduced, the suction efficiency is enhanced, and the compression efficiency is enhanced.

FIG. 5 is a diagram showing a relation between a supply rate of lubricant oil with respect to an amount of sucked refrigerant and a ratio of performance coefficient (ratio of COP) when R410A is used as the refrigerant and when carbon dioxide is used as the refrigerant. The diagram when the carbon dioxide was used was measured under the conditions of discharge pressure 9 MPa, suction pressure 5 MPa and rotation frequency 37 Hz. The diagram when R410A was used was measured using a scroll compressor which was designed such that refrigeration ability and frequency are substantially the same as those of the condition when the carbon dioxide was used. As can be found in FIG. 5, when R410A is used, as the supply rate of lubricant oil with respect to the amount of sucked refrigerant is smaller, the ratio of performance coefficient is more enhanced.

However, it is difficult to appropriately supply lubricant oil to the suction space only by reducing the suction resistance as in the scroll compressor described in patent document 1, and the compression efficiency is adversely influenced and its performance is deteriorated.

That is, lubricant oil supplied to the suction space is swept away along the flow of the refrigerant and more lubricant oil is supplied to a compression chamber formed in a center direction of the orbiting scroll part. Therefore, lubricant oil supplied to the compression chamber formed in the outer peripheral direction of the orbiting scroll part becomes insufficient, the leakage in the outer peripheral side compression chamber is increased, and the performance is deteriorated. If the supply rate of lubricant oil is increased to compensate the oil supply shortage in the outer peripheral direction of the orbiting scroll part, suction overheat is caused and the volumetric efficiency is deteriorated.

A flow path of the refrigerant entering the suction space is largely bent until the refrigerant is enclosed in the compression chamber. At that time, there is a problem that the refrigerant collides against a wall surface or a swirl is formed, pressure loss is generated and the performance is deteriorated.

As a control method for reducing the supply rate of lubricant oil to enhance the performance coefficient, there are a method for increasing pressure loss of the narrowed portion 12, and a method for increasing the set pressure in the back pressure chamber 8 to make it difficult to open the valve 11. In the case of the former method, if the narrowed portion 12 is reduced, the possibility that the narrowed portion 12 is closed by contamination is increased, and when the narrowed portion 12 is closed, the lubricant oil is not supplied to the compression chamber 5, galling or abnormal wearing is generated, and the reliability of the compressor is largely deteriorated. In the case of the latter method, if the set pressure is increased, a force for pushing the orbiting scroll part 4 against the fixed scroll part 2 is abnormally increased at the time of high load operation. As a result, galling or abnormal wearing is generated in the pushing surface, and the reliability of the compressor is largely deteriorated. The methods for controlling the supply rate of lubricant oil have such problems.

Further, if HFC-based refrigerant or HCFC-based refrigerant is used as the refrigerant, since the refrigeration effect per unit circulation amount is small as compared with carbon dioxide, the lap 4*a* of the orbiting scroll part 4 is increased in height. Thus, there is a problem that pressure loss is generated by swirl generated during the suction process, the suction efficiency is deteriorated, and since the refrigerant and lubricant oil are not sufficiently, leakage loss is increased.

When carbon dioxide is used as the refrigerant, as can be found in FIG. 5, an optimal value at which the ratio of performance coefficient becomes maximum exists in the supply rate of lubricant oil with respect to the amount of sucked refrigerant. However, since a pressure difference between discharge pressure and suction pressure is about 7 to 10 times higher than that of the conventional refrigeration cycle using CFCs as the refrigerant, small shortage of seal oil increases leakage of compression chamber, and the performance is deteriorated.

The present invention has been accomplished in view of the conventional problems, and it is an object of the invention to provide a simple, inexpensive, efficient and reliable scroll compressor.

DISCLOSURE OF THE INVENTION

A first aspect of the present invention provides a scroll compressor in which a fixed scroll part and an orbiting scroll part are meshed with each other to form a compression chamber, the orbiting scroll part is allowed to orbit in a circular orbit while restraining the orbiting scroll part from rotating by a rotation-restraint mechanism, a refrigerant is sucked, compressed and discharged while continuously varying a capacity of the compression chamber, wherein an oil supply passage is formed in a suction space of the fixed scroll part, and the suction space is provided with an oil collision part.

With this aspect, the amount of oil to be supplied to the compression chamber can be controlled by resistance generated when lubricant oil collides against the oil collision part. That is, the suction overheat is minimized, minimum oil as seal oil can be supplied and thus, it is possible to provide an efficient scroll compressor.

According to a second aspect of the invention, in the scroll compressor of the first aspect, a gap is formed between the oil collision part and a wall surface of the suction space.

With this aspect, lubricant oil which collides against the oil collision part passes through the gap and is separated and introduced into the outer peripheral direction of the orbiting scroll part and the center direction. Therefore, it is possible to prevent the supply of oil from being deviated toward the center direction of the orbiting scroll part, and to prevent lubricant oil from being reduced in the outer peripheral direction of the orbiting scroll part. That is, it is unnecessary to increase the oil amount (supply rate) to compensate the shortage of oil supply to the outer peripheral direction of the orbiting scroll part, and it is possible to reduce the suction overheat, to sufficiently supply seal oil, and to provide a more efficient scroll compressor.

According to a third aspect of the invention, in the scroll compressor of the second aspect, the gap comprises a first gap formed from the oil supply passage toward a suction pipe and a second gap formed from the oil supply passage toward the compression chamber, and the first gap is greater than the second gap.

With this aspect, since more lubricant oil is introduced by the first gap and supplied in the outer peripheral direction of the orbiting scroll part, it is possible to provide a more efficient scroll compressor when load is high.

According to a fourth aspect of the invention, in the scroll compressor of the second aspect, the gap comprises a first gap formed from the oil supply passage toward a suction pipe and a second gap formed from the oil supply passage toward the compression chamber, and the second gap is greater than the first gap.

With this aspect, since more lubricant oil is introduced by the second gap and supplied in the center direction of the orbiting scroll part, it is possible to provide a more efficient scroll compressor when load is low.

According to a fifth aspect of the invention, in the scroll compressor of the first aspect, a side surface of the oil collision part on the side of a refrigerant passage is a concave curved surface, one of end surfaces of the curved surface is formed on an extension surface of a suction pipe connected to the suction space, an intersection angle between a tangent of the one end surface of the curved surface and a tangent of the other end surface of the curved surface is an acute angle.

With this aspect, since the suction-side end surface is formed on the extension of the wall surface of the suction space, the pressure loss caused by the swirl generated in the suction process of the refrigerant can be minimized, and the suction efficiency can be enhanced. Further, since the intersection angle is acute, the refrigerant is curved on the center-side end surface and smoothly flows toward the compression chamber formed in the outer peripheral direction of the orbiting scroll part, and the volumetric efficiency of the compression chamber on the side of the outer periphery can be enhanced.

According to a sixth aspect of the invention, in the scroll compressor of the first aspect, a side surface of the oil collision part on the side of a refrigerant passage is a concave curved surface, one of end surfaces of the curved surface is formed on an extension surface of a suction pipe connected to the suction space, an intersection angle between a tangent of the one end surface of the curved surface and a tangent of the other end surface of the curved surface is an obtuse angle.

With this aspect, since the suction-side end surface is formed on the extension of the wall surface of the suction space, the pressure loss caused by the swirl generated in the suction process of the refrigerant can be minimized, and the suction efficiency can be enhanced. Further, the intersection angle is obtuse, refrigerant is introduced to the center-side end surface and smoothly flows toward the compression chamber formed in the center direction of the orbiting scroll part, and the volumetric efficiency of the compression chamber on the center side can be enhanced.

According to a seventh aspect of the invention, in the scroll compressor of the fifth or sixth aspect, at least one of ends constituting the side surface of the oil collision part on the side of a refrigerant passage is formed into an r-shape.

With this aspect, peeling-off of flow of refrigerant at the both ends can be prevented, and the suction efficiency can be enhanced.

According to an eighth aspect of the invention, in the scroll compressor of any one of the first to sixth aspects, HFC-based refrigerant or HCFC-based refrigerant is used as the refrigerant.

When the HFC-based refrigerant or HCFC-based refrigerant is used, performance is deteriorated due to the lap height in which cooling effect per unit circulation amount is taken into consideration, but according to the embodiment, since the generation of swirl during the suction process is suppressed, the suction efficiency is enhanced, refrigerant and lubricant oil are sufficiently mixed with each other to enhance the sealing ability and thus, it is possible to avoid the deterioration of performance. Thus, it is possible to provide a scroll compressor using HFC-based refrigerant or HCFC-based refrigerant.

According to a ninth aspect of the invention, in the scroll compressor of any one of the first to sixth aspects, carbon dioxide is used as the refrigerant.

When carbon dioxide refrigerant is used, since the carbon dioxide refrigerant has large pressure difference of compression chamber, performance of compression chamber is deteriorated due to leakage even with slight lack of seal oil, but if the structure of the embodiment is employed, it is possible to avoid the deviation of oil supply, refrigerant and lubricant oil are sufficiently mixed with each other to enhance the sealing ability, and it is possible to avoid the deterioration of performance. Thus, it is possible to provide a scroll compressor using carbon dioxide refrigerant.

BEST MODE FOR CARRYING OUT THE INVENTION

Embodiments of the present invention will be explained with reference to the drawings.

First Embodiment

Figure 1:
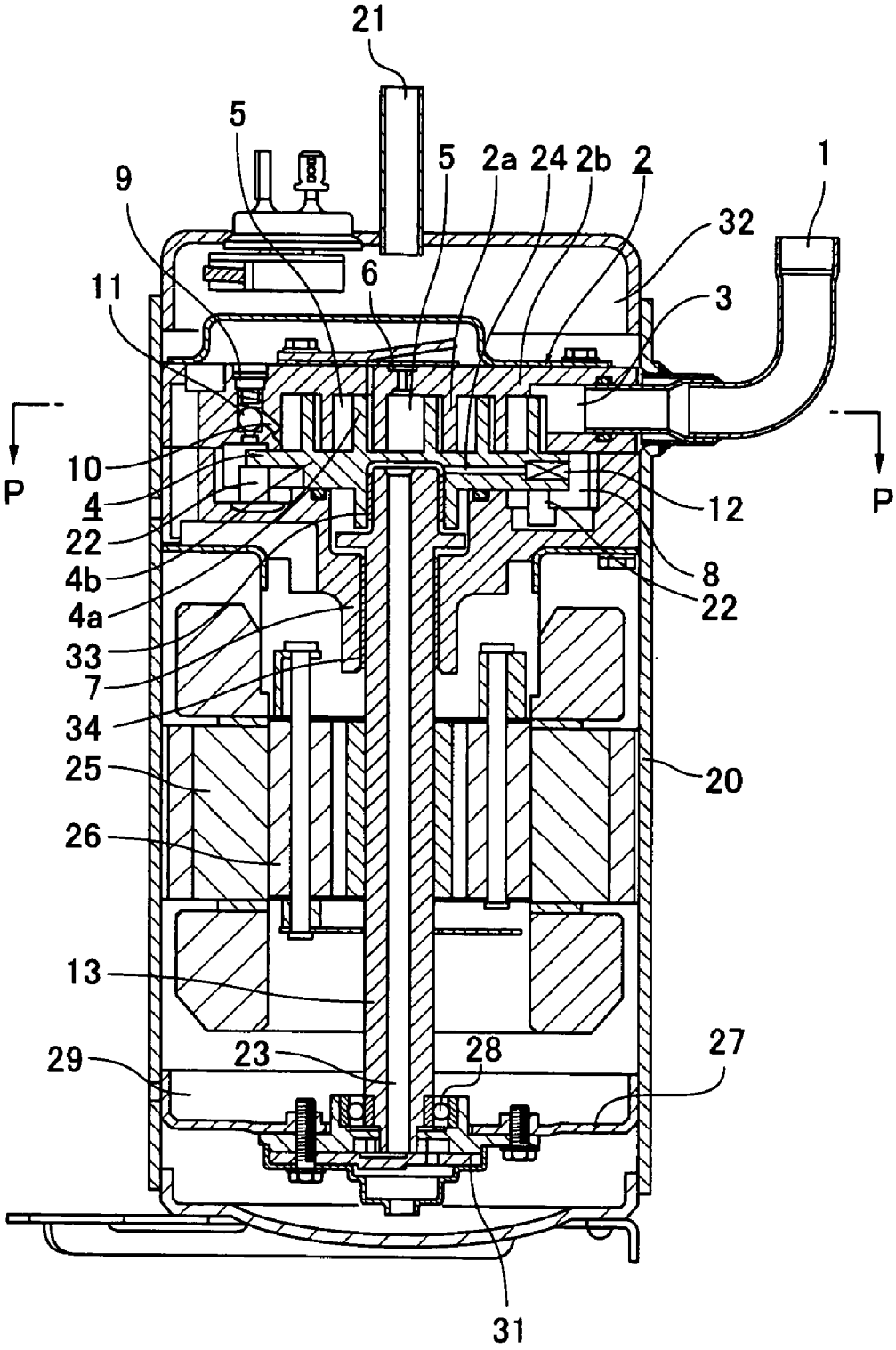
FIG. 1 is a sectional view showing a scroll compressor of a first embodiment of the present invention.
Figure 4:
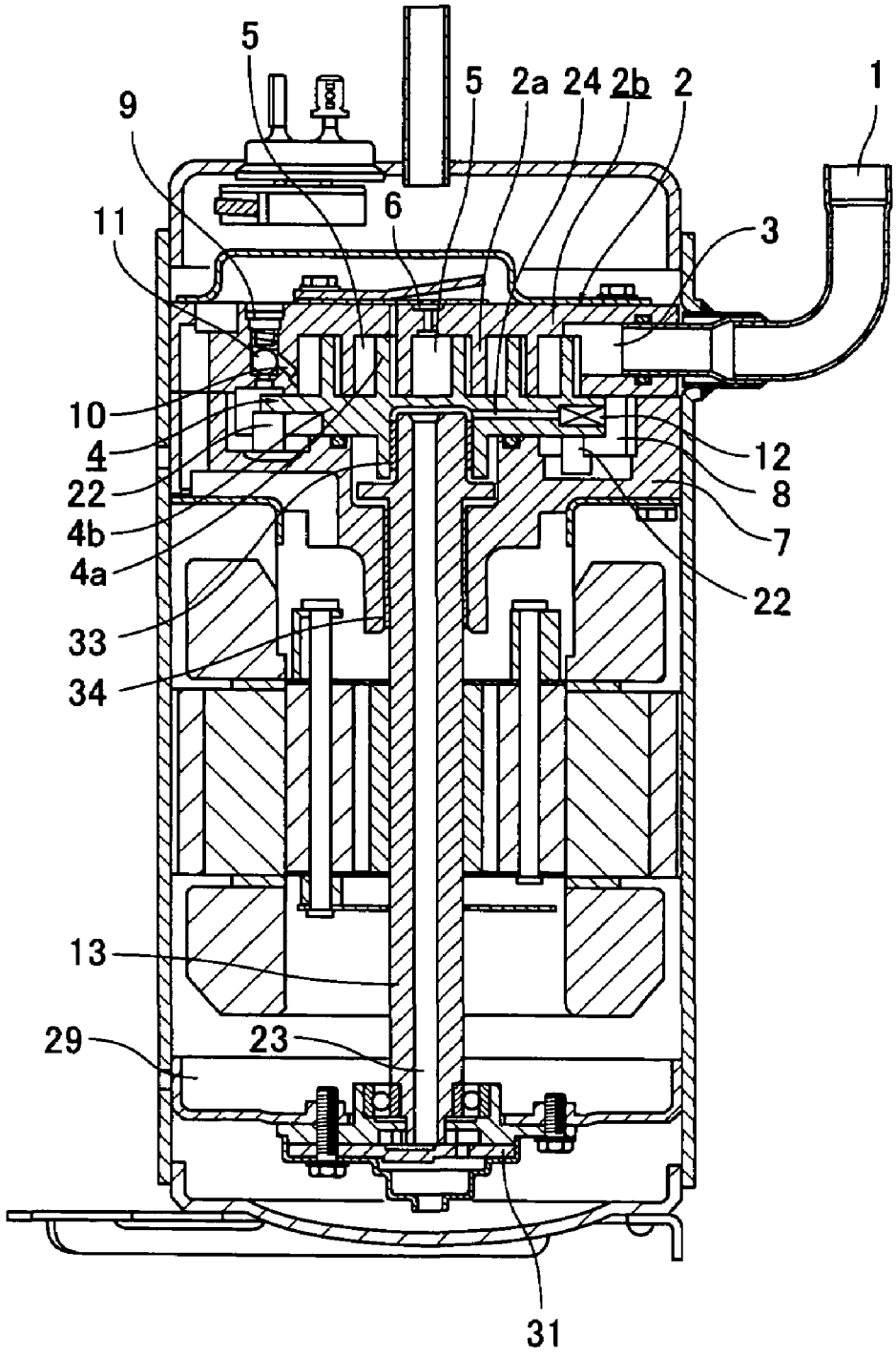
FIG. 4 is a sectional view showing a conventional scroll compressor.
Figure 5:
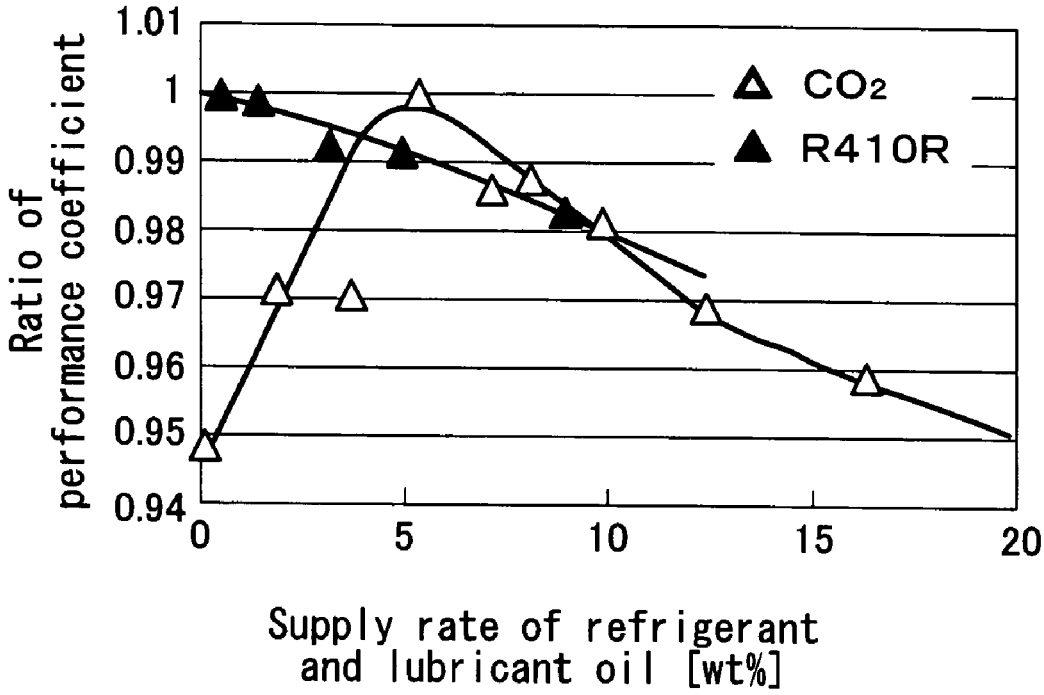
FIG. 5 is a diagram showing a relation between a supply rate of lubricant oil/refrigerant and a ratio of performance coefficient.

FIG. 1 is a sectional view showing a scroll compressor of a first embodiment of the present invention. The same members as those of the conventional scroll compressor shown in FIG. 4 are designated with the same symbols.

The scroll compressor of the embodiment includes a compressor mechanism and a motor mechanism in a container 20. The compressor mechanism is disposed at an upper portion in the container 20, and the motor mechanism is disposed below the compressor mechanism. The container 20 is provided at its upper portion with a suction pipe 1 and a discharge pipe 21. An oil reservoir 29 for accumulating lubricant oil is provided at a lower portion in the container 20.

The compressor mechanism includes a fixed scroll part 2 and an orbiting scroll part 4. The fixed scroll part 2 and the orbiting scroll part 4 are meshed with each other to form a plurality of compression chambers 5. The fixed scroll part 2 has a scroll lap 2*a* rising from a mirror plate 2*b*, and the orbiting scroll part 4 has a scroll lap 4*a* rising from a mirror plate 4*b*. The compression chamber 5 is formed between the mirror plate 2*b* and the mirror plate 4*b* by meshing the lap 2*a* and the lap 4*a* with each other. The orbiting scroll part 4 is restrained from rotating by a rotation-restraint mechanism 22, and the orbiting scroll part 4 orbits in a circular orbit. The compression chamber 5 moves while varying its capacity by orbiting motion of the orbiting scroll part 4. Predetermined back pressure is applied to an outer periphery of the orbiting scroll part 4 and a back surface of the lap so that the orbiting scroll part 4 is not separated from the fixed scroll part 2 and does not flip over.

The motor mechanism includes a stator 25 which is fixed to an inner side of a compressed container 20, and a rotor 26 which is rotatably supported on the inner side of the stator 25. A shaft 13 is fitted into the rotor 26. The shaft 13 is supported by a bearing member 7 and a ball bearing 28 held by an auxiliary bearing member 27.

Refrigerant sucked from the suction pipe 1 passes through the suction space 3 of the fixed scroll part 2, and is enclosed in the compression chamber 5 formed by meshing the fixed scroll part 2 and the orbiting scroll part 4 with each other, and is compressed toward the center of the fixed scroll part 2, and is discharged into an upper space 32 in the compressed container 20 from a discharge port 6.

The back pressure chamber 8 is formed such as to be surrounded by the fixed scroll part 2 and the bearing member 7. It is necessary that the back pressure chamber 8 always has such a back pressure that the orbiting scroll part 4 is not separated from the fixed scroll part 2. The back pressure adjusting mechanism 9 for always maintaining the back pressure at a constant level has a communication passage 10 as an oil supply passage which is in communication with the suction space 3 from the back pressure chamber 8 through the fixed scroll part 2, and the communication passage 10 is provided with the valve 11.

If the pressure in the back pressure chamber 8 becomes higher than a set pressure, the valve 11 is opened, lubricant oil in the back pressure chamber 8 is supplied to the suction space 3, and the pressure in the back pressure chamber 8 is maintained at a constant intermediate pressure. The intermediate pressure is applied to the back surface of the orbiting scroll part 4 so as to prevent the orbiting scroll part 4 from flipping over during operation. The lubricant oil supplied to the suction space 3 moves to the compression chamber 5 together with the orbiting motion of the orbiting scroll part 4, and this prevents refrigerant from leaking from the compression chamber 5.

Lubricant oil accumulated in the oil reservoir 29 of the container 20 is introduced into an upper end of the shaft 13 by an oil pump 31 through the passage 23 formed in the shaft 13. The lubricant oil introduced into the upper end of the shaft 13 lubricates the sliding surface 33 between the shaft 13 and the orbiting scroll part 4 and the sliding surface 34 between the shaft 13 and the bearing member 7. A portion of the lubricant oil passes through the passage 24 provided in the orbiting scroll part 4, and is decompressed by the narrowed portion 12 mounted on the passage 24 and then, is supplied to the back pressure chamber 8.

If the pressure in the back pressure chamber 8 becomes higher than the set pressure, the valve 11 is opened, the lubricant oil accumulated in the back pressure chamber 8 passes through the communication passage 10, collides against an oil collision part 14 (not shown) and is supplied to the suction space 3 and functions as lubricant oil and seal oil for meshing portions of the fixed scroll part and the orbiting scroll part.

In FIG. 1 showing this embodiment, since the suction pipe 1 and the suction space 3, or the back pressure adjusting mechanism 9 and the communication passage 10 are superposed, they are described such as they are separated into left and right with respect to the shaft 13 for convenience sake. The oil collision part 14 is not shown in FIG. 1 but is shown in FIG. 2.

Figure 2:
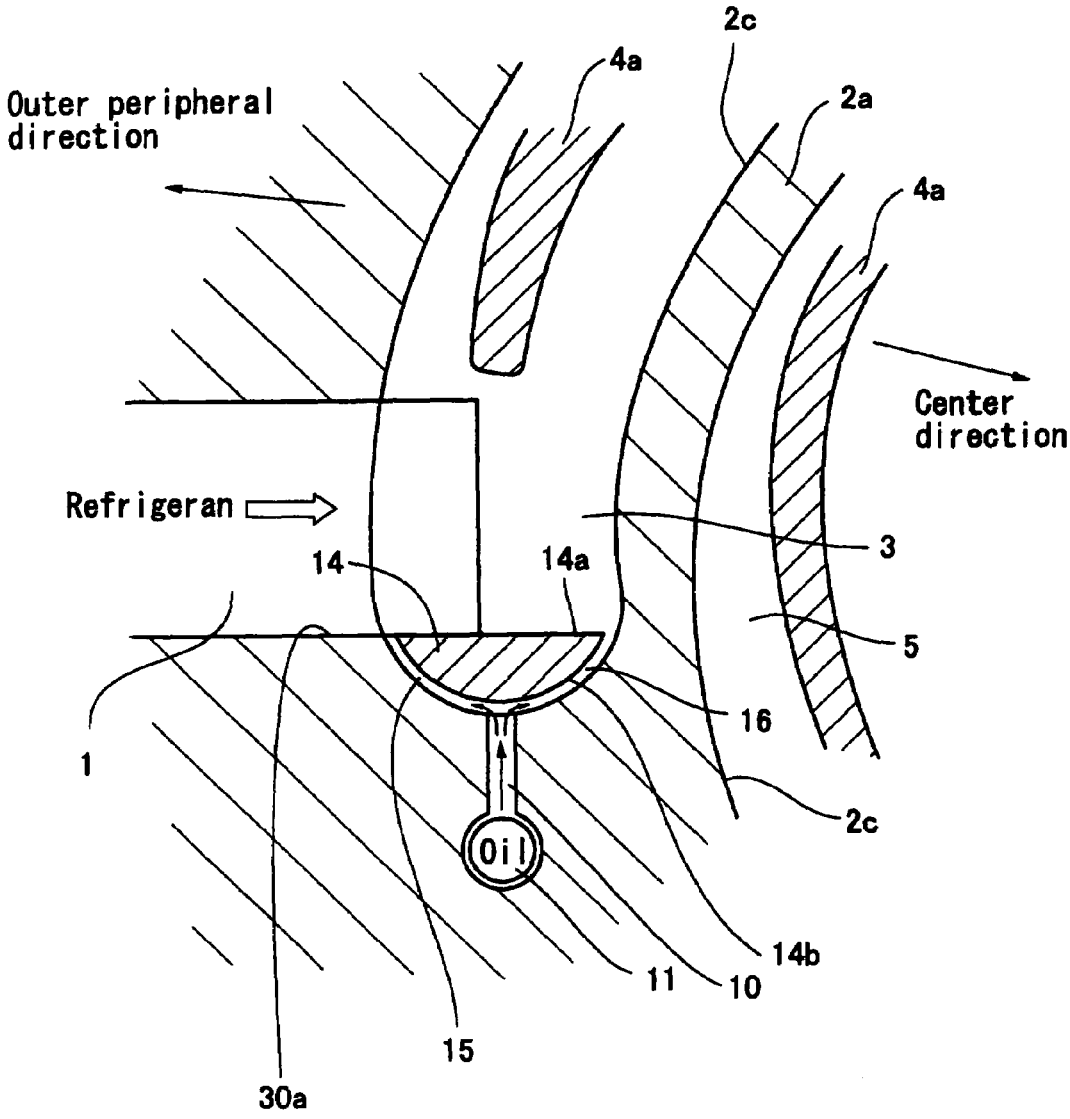
FIG. 2 is a partial enlarged sectional view showing a state in which a fixed scroll part and an orbiting scroll part shown in FIG. 1 are meshed with each other.

FIG. 2 is a partial enlarged sectional view showing a state in which the fixed scroll part and the orbiting scroll part are meshed with each other. The structure of the first embodiment will be explained with reference to FIG. 2. FIG. 2 is the sectional view taken along the line P-P in FIG. 1.

The fixed scroll part 2 of the embodiment is formed with an involute groove 2*c* (groove 2*c*, hereinafter) and the suction space 3. The lap 4*a* of the orbiting scroll part 4 is inserted into the groove 2*c*, thereby meshing the fixed scroll part 2 and the orbiting scroll part 4 with each other. The suction space 3 is in communication with the suction pipe 1 which sucks the refrigerant.

The suction space 3 is formed with the communication passage 10 for supplying lubricant oil to the suction space 3 through the valve 11 of the back pressure adjusting mechanism 9. An outlet of the communication passage 10 opening at the suction space 3 is provided with the oil collision part 14 for allowing the lubricant oil supplied from the communication passage 10 to collide.

The oil collision part 14 of the first embodiment includes a flat refrigerant passage side surface 14*a*, and a convex lubricant oil passage side surface 14*b* extending along a wall surface of the suction space 3. The refrigerant passage side surface 14*a* coincides with an extension of a wall surface 30*a* of the suction pipe 1.

In the scroll compressor of the first embodiment, lubricant oil is supplied to the suction space 3 from the back pressure chamber 8 through the communication passage 10. By allowing the lubricant oil to collide against the oil collision part 14, the amount of oil (supply rate of lubricant oil) to be supplied to the compression chamber 5 can be reduced. That is, the oil collision part 14 is used as a resistor of a flow path, the lubricant oil supplied to the compression chamber 5 is controlled to an amount of minimum oil as seal oil, and it is possible to prevent the deterioration of the volumetric efficiency caused by the suction overheat. Therefore, it is possible to provide a reliable and efficient scroll compressor.

Further, in the embodiment, a first gap 15 and a second gap 16 are formed between the oil collision part 14 and a wall surface of the suction space 3. The first gap 15 introduces lubricant oil in the direction of the suction pipe 1 from the communication passage 10 along the wall surface of the suction space 3. The second gap 16 introduces lubricant oil into a direction of a center of the orbiting scroll part 4 from the communication passage 10 along the wall surface of the suction space 3. With this structure, the lubricant oil flowing out from the communication passage 10 is divided into two directions.

With the above-described structure, one of lubricant oil flows flowing through the first gap 15 in the outer peripheral direction is supplied into the outer peripheral direction of the orbiting scroll part 4. Therefore, before the lubricant oil is supplied to the compression chamber 5, the lubricant oil and refrigerant coming from the suction pipe 1 can sufficiently be mixed and the seal effect is enhanced. The mixed lubricant oil is supplied toward the compression chamber 5 formed in the outer peripheral direction as viewed from the lap 4*a* of the orbiting scroll part 4. The other lubricant oil flow flowing through the second gap 16 in the center direction of the orbiting scroll part 4 is supplied to the compression chamber 5 formed in the center direction as viewed from the lap 4*a* of the orbiting scroll part 4.

In the scroll compressor having such a structure, the first gap 15 and the second gap 16 which divides the lubricant oil into two flows are formed between the oil collision part 14 and the wall surface of the suction space 3. With this, lubricant oil can be supplied while keeping excellent balance without deviation, and the amount of oil supplied to the compression chamber 5 (supply rate of lubricant oil) can be reduced. That is, the overheat of the refrigerant caused by the lubricant oil at the time of suction can be minimized, it is possible to enhance the seal effect of the compression chamber 5 to the utmost, and to provide an efficient scroll compressor.

Although the first gap 15 and the second gap 16 have substantially the same sizes in the first embodiment, the following structure may be employed.

That is, if the first gap 15 is made greater than the second gap 16 (not shown), lubricant oil which flows out from the communication passage 10 and is introduced into the first gap 15 is more supplied in the outer peripheral direction. Then, the lubricant oil and the refrigerant are mixed, and the seal effect is enhanced. Therefore, the amount of oil to be supplied to the compression chamber 5 can be reduced, and it is possible to provide an efficient scroll compressor.

Especially when the scroll compressor is operated with high load, since the gap in the lap direction (axial direction) of the compression chamber 5 formed in the outer peripheral direction as viewed from the lap 4*a* of the orbiting scroll part 4 becomes greater, it is preferable that the first gap 15 is greater than the second gap 16. The first gap 15 is made greater than the second gap 16, lubricant oil is sufficiently mixed with refrigerant to enhance the seal effect, and such lubricant oil can be supplied, in greater amount, to the compression chamber 5 formed in the outer peripheral direction as viewed from the lap 4*a* of the orbiting scroll part 4, and leakage loss can be reduced more effectively.

On the other hand, if the second gap 16 is made greater than the first gap 15 (not shown), lubricant oil which is introduced to the greater second gap 16 is supplied, in greater amount, to the compression chamber 5 formed in the center direction as viewed from the lap 4*a* of the orbiting scroll part 4, and the seal effect is enhanced. Therefore, it is possible to provide an efficient scroll compressor.

Especially when the scroll compressor is operated with low load, since the gap in the lap direction (axial direction) of the compression chamber 5 formed in the center direction as viewed from the lap 4*a* of the orbiting scroll part 4 becomes greater, it is preferable that the second gap 16 is greater than the first gap 15. The second gap 16 is made greater than the first gap 15, and more lubricant oil can be supplied to the compression chamber 5 formed in the center direction as viewed from the lap 4*a* of the orbiting scroll part 4, and the leakage loss can be reduced more effectively.

Figure 3:
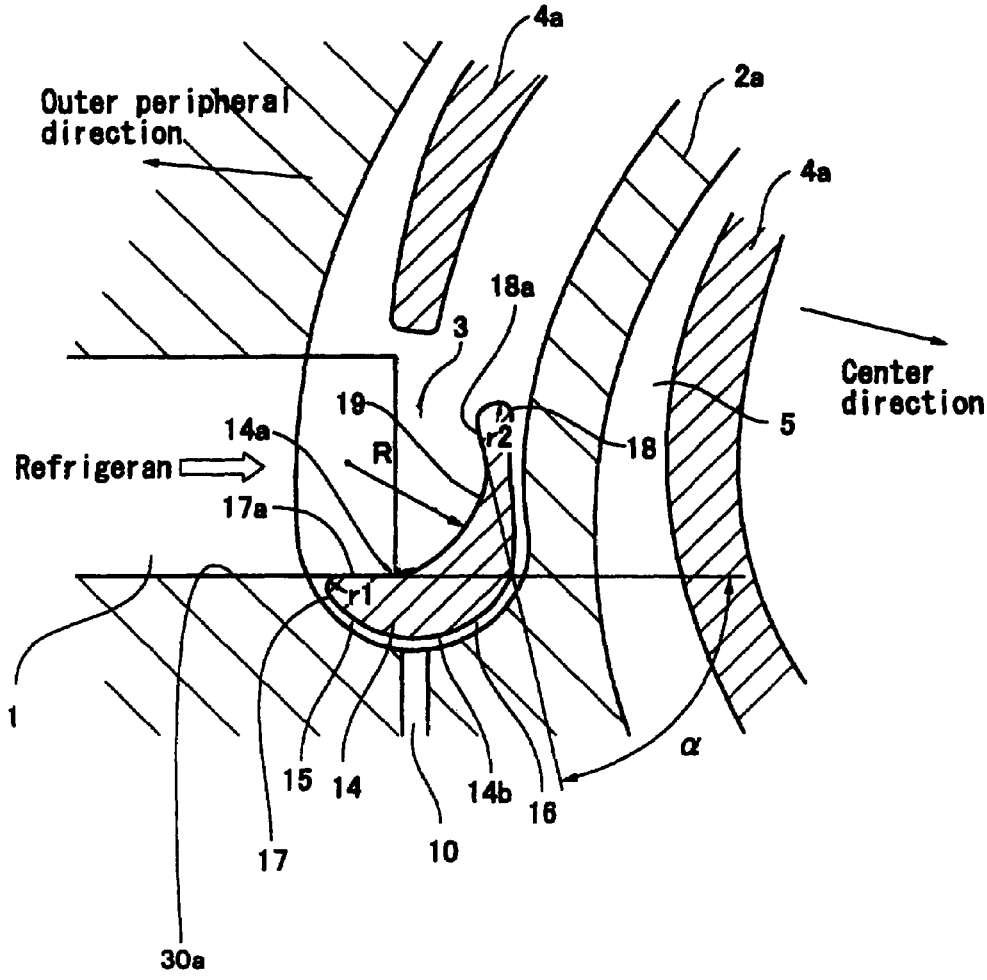
FIG. 3 is a partial enlarged sectional view showing a state in which a fixed scroll part and an orbiting scroll part of a second embodiment of the invention are meshed with each other.

Next, a scroll compressor of a second embodiment will be explained with reference to FIG. 3. The scroll compressor of the second embodiment is different from that of the first embodiment only in the structure of the oil collision part 14, and explanation of structure and operation of other portions will be omitted. FIG. 3 is a partial enlarged sectional view showing a state in which a fixed scroll part and an orbiting scroll part of the second embodiment of the invention are meshed with each other.

A cross section of the oil collision part 14 of the second embodiment is formed into a substantially crescent shape by a concave refrigerant passage side surface 14*a* extending along a flow direction of refrigerant and by a convex lubricant oil passage side surface 14*b* extending along a wall surface of the suction space 3. The refrigerant passage side surface 14*a* includes a suction-side end 17, a flat suction-side end surface 17*a*, a center-side end 18, a flat center-side end surface 18*a*, and a central surface 19 connecting both the end surfaces 17*a* and 18*a* to each other through a crescent curve surface. The suction-side end surface 17*a* coincides with an extension of the wall surface 30*a* of the suction pipe 1 which is in communication with the suction space 3. The refrigerant passage side surface 14*a* of the oil collision part 14 is formed into such a shape that an angle $\alpha$ formed by intersection between a tangent of the suction-side end surface 17*a* and a tangent of the center-side end surface 18*a* becomes an acute angle.

With the scroll compressor having such a structure, the suction-side end surface 17*a* is formed on the extension of the wall surface of the suction pipe 1, the flow of refrigerant can be smoothened, the pressure loss caused by swirl generated in the suction process of the refrigerant can be minimized, and the suction efficiency can be enhanced. By setting the intersection angle $\alpha$ into the acute angle, the flowing direction of refrigerant can be oriented in the outer peripheral direction of the orbiting scroll part 4 and thus, refrigerant and lubricant oil flow smoothly toward the compression chamber 5 formed in the outer peripheral direction as viewed from the lap 4*a* of the orbiting scroll part 4, and the volumetric efficiency in the compression chamber 5 can be enhanced. Especially when the scroll compressor is operated with high load at which the gap in the lap direction of the compression chamber 5 is increased, the volumetric efficiency can be enhanced, and it is possible to provide an efficient scroll compressor.

As shown in FIG. 3, when the suction-side end 17 is formed into an r (curve r1) shape and the center-side end 18 is formed into an r (curve r2) shape, since it is possible to prevent peeling-off and collision of the flow at each end, refrigerant flows smoothly, and it is possible to provide an efficient scroll compressor.

In this embodiment, the intersection angle $\alpha$ is acute angle but the intersection angle $\alpha$ may be an obtuse angle.

That is, the refrigerant passage side surface 14*a* of the oil collision part 14 is formed into such a shape that the intersection angle $\alpha$ between the tangent of the suction-side end surface 17*a* and the tangent of the center-side end surface 18*a* is an obtuse angle.

With this structure, the pressure loss caused the swirl generated during the suction process of refrigerant can be minimized, and the suction efficiency can be enhanced. Since the intersection angle $\alpha$ is the obtuse angle, refrigerant smoothly flows through the compression chamber 5 formed in the center direction as viewed from the lap 4*a* of the orbiting scroll part 4. When the scroll compressor is operated with low load, the gap in the lap direction of the compression chamber 5 is increased, but if this structure is employed, the volumetric efficiency of the compression chamber 5 can be enhanced, and it is possible to provide a more efficient scroll compressor.

When HFC-based refrigerant or HCFC-based refrigerant is used, swirl generated during the suction process and insufficient mix of refrigerant and lubricant oil increases the pressure loss and leakage loss, but if the structure in the above embodiment is employed, refrigerant flows smoothly and the swirl is prevented from being generated. Therefore, refrigerant and lubricant oil can be sufficiently mixed before they are compressed and thus, it is possible to prevent the pressure loss and leakage loss.

Since the carbon dioxide refrigerant has large pressure difference between the discharge pressure and the suction pressure, the leakage of compression chamber is increased and performance is deteriorated even with slight lack of seal oil, but if the structure of the above embodiment is employed, worry of shortage of oil supply caused by deviation of oil supply is eliminated, and refrigerant and lubricant oil are sufficiently mixed with each other before they are compressed, and sealing ability can be enhanced.

As apparent from the above embodiment, according to the present invention, the oil supply passage is formed in the suction space of the fixed scroll part, and the suction space is provided with the oil collision part. According to the invention, the amount of oil to be supplied to the compression chamber can be controlled by resistance generated when lubricant oil collides against the oil collision part. That is, the suction overheat is minimized, minimum oil as seal oil can be supplied and thus, it is possible to provide an efficient scroll compressor.

In the present invention, the gap is formed between the oil collision part and the wall surface of the suction space. According to the invention, lubricant oil which collides against the oil collision part passes through the gap and is separated and introduced into the outer peripheral direction of the orbiting scroll part and the center direction. Therefore, it is possible to prevent the supply of oil from being deviated toward the center direction of the orbiting scroll part, and to prevent lubricant oil from being reduced in the outer peripheral direction of the orbiting scroll part. That is, it is unnecessary to increase the oil amount (supply rate) to compensate the shortage of oil supply to the outer peripheral direction of the orbiting scroll part, and it is possible to reduce the suction overheat, to sufficiently supply seal oil, and to provide a more efficient scroll compressor.

In the present invention, the gap comprises a first gap formed from the oil supply passage toward the suction pipe and a second gap formed from the oil supply passage toward the compression chamber, and the first gap is greater than the second gap. According to this invention, since more lubricant oil is introduced by the first gap and supplied in the outer peripheral direction of the orbiting scroll part, it is possible to provide a more efficient scroll compressor when load is high.

Further, in the invention, the gap comprises a first gap formed from the oil supply passage toward the suction pipe and a second gap formed from the oil supply passage toward the compression chamber, and the second gap is greater than the first gap. According to this invention, since more lubricant oil is introduced by the second gap and supplied in the center direction of the orbiting scroll part, it is possible to provide a more efficient scroll compressor when load is low.

In the invention, a side surface of the oil collision part on the side of a refrigerant passage is a concave curved surface, one of end surfaces of the curved surface is formed on an extension surface of a suction pipe connected to the suction space, an intersection angle between a tangent of the one end surface of the curved surface and a tangent of the other end surface of the curved surface is an acute angle. According to this invention, since the suction-side end surface is formed on the extension of the wall surface of the suction space, the pressure loss caused by the swirl generated in the suction process of the refrigerant can be minimized, and the suction efficiency can be enhanced. Further, since the intersection angle is acute, the refrigerant is curved on the center-side end surface and smoothly flows toward the compression chamber formed in the outer peripheral direction of the orbiting scroll part, and the volumetric efficiency of the compression chamber on the side of the outer periphery can be enhanced.

In the invention, a side surface of the oil collision part on the side of a refrigerant passage is a concave curved surface, one of end surfaces of the curved surface is formed on an extension surface of a suction pipe connected to the suction space, an intersection angle between a tangent of the one end surface of the curved surface and a tangent of the other end surface of the curved surface is an obtuse angle. According to this invention, since the suction-side end surface is formed on the extension of the wall surface of the suction space, the pressure loss caused by the swirl generated in the suction process of the refrigerant can be minimized, and the suction efficiency can be enhanced. Further, the intersection angle is obtuse, refrigerant is introduced to the center-side end surface and smoothly flows toward the compression chamber formed in the center direction of the orbiting scroll part, and the volumetric efficiency of the compression chamber on the center side can be enhanced.

In the invention, at least one of ends constituting the side surface of the oil collision part on the side of a refrigerant passage is formed into a r-shape. According to this invention, peeling-off of flow of refrigerant at the both ends can be prevented, and the suction efficiency can be enhanced.

In the invention, HFC-based refrigerant or HCFC-based refrigerant is used as the refrigerant. According to this invention, when the HFC-based refrigerant or HCFC-based refrigerant is used, performance is deteriorated due to the lap height in which cooling effect per unit circulation amount is taken into consideration, but according to the embodiment, since the generation of swirl during the suction process is suppressed, the suction efficiency is enhanced, refrigerant and lubricant oil are sufficiently mixed with each other to enhance the sealing ability and thus, it is possible to avoid the deterioration of performance. Thus, it is possible to provide a scroll compressor using HFC-based refrigerant or HCFC-based refrigerant.

In the invention, carbon dioxide is used as the refrigerant. According to this invention, when carbon dioxide refrigerant is used, since the carbon dioxide refrigerant has large pressure difference of compression chamber, performance of compression chamber is deteriorated due to leakage even with slight lack of seal oil, but if the structure of the embodiment is employed, it is possible to avoid the deviation of oil supply, refrigerant and lubricant oil are sufficiently mixed with each other to enhance the sealing ability, and it is possible to avoid the deterioration of performance. Thus, it is possible to provide a scroll compressor using carbon dioxide refrigerant.

INDUSTRIAL APPLICABILITY

According to the present invention, as described above, it is possible to provide a simple, inexpensive, efficient and reliable scroll compressor.

The invention claimed is:

1. A scroll compressor in which a fixed scroll part and an orbiting scroll part are meshed with each other to form a compression chamber, said orbiting scroll part is allowed to orbit in a circular orbit while restraining said orbiting scroll part from rotating by a rotation-restraint mechanism, a refrigerant is sucked, compressed and discharged while continuously varying a capacity of said compression chamber, wherein an oil supply passage is formed in a suction space of said fixed scroll part, and said suction space is provided with an oil collision part, wherein a side surface of said oil collision part on the side of a refrigerant passage is a concave curved surface, one of end surfaces of said curved surface is formed on an extension surface of a suction pipe connected to said suction space, an intersection angle between a tangent of said one end surface of said curved surface and a tangent of the other end surface of said curved surface is an acute angle.

2. The scroll compressor according to claim 1, wherein a gap is formed between said oil collision part and a wall surface of said suction space.

3. The scroll compressor according to claim 2, wherein HFC-based refrigerant or HCFC-based refrigerant is used as said refrigerant.

4. The scroll compressor according to claim 2, wherein carbon dioxide is used as said refrigerant.

5. The scroll compressor according to claim 2, wherein said gap comprises a first gap formed from said oil supply passage toward a suction pipe and a second gap formed from said oil supply passage toward said compression chamber, and said first gap is greater than said second gap.

6. The scroll compressor according to claim 5, wherein HFC-based refrigerant or HCFC-based refrigerant is used as said refrigerant.

7. The scroll compressor according to claim 5, wherein carbon dioxide is used as said refrigerant.

8. The scroll compressor according to claim 2, wherein said gap comprises a first gap formed from said oil supply passage toward a suction pipe and a second gap formed from said oil supply passage toward said compression chamber, and said second gap is greater than said first gap.

9. The scroll compressor according to claim 8, wherein HFC-based refrigerant or HCFC-based refrigerant is used as said refrigerant.

10. The scroll compressor according to claim 8, wherein carbon dioxide is used as said refrigerant.

11. The scroll compressor according to claim 1, wherein at least one of ends constituting the side surface of said oil collision part on the side of a refrigerant passage is formed into a r-shape.

12. The scroll compressor according to claim 1, wherein HFC-based refrigerant or HCFC-based refrigerant is used as said refrigerant.

13. The scroll compressor according to claim 1, wherein carbon dioxide is used as said refrigerant.

14. A scroll compressor in which a fixed scroll part and an orbiting scroll part are meshed with each other to form a compression chamber, said orbiting scroll part is allowed to orbit in a circular orbit while restraining said orbiting scroll part from rotating by a rotation-restraint mechanism, a refrigerant is sucked, compressed and discharged while continuously varying a capacity of said compression chamber, wherein an oil supply passage is formed in a suction space of said fixed scroll part, and said suction space is provided with an oil collision part, wherein a side surface of said oil collision part on the side of a refrigerant passage is a concave curved surface, one of end surfaces of said curved surface is formed on an extension surface of a suction pipe connected to said suction space, an intersection angle between a tangent of said one end surface of said curved surface and a tangent of the other end surface of said curved surface is an obtuse angle.

15. The scroll compressor according to claim 14, wherein a gap is formed between said oil collision part and a wall surface of said suction space.

16. The scroll compressor according to claim 15, wherein said gap comprises a first gap formed from said oil supply passage toward a suction pipe and a second gap formed from said oil supply passage toward said compression chamber, and said first gap is greater than said second gap.

17. The scroll compressor according to claim 16, wherein HFC-based refrigerant or HCFC-based refrigerant is used as said refrigerant.

18. The scroll compressor according to claim 16, wherein carbon dioxide is used as said refrigerant.

19. The scroll compressor according to claim 15, wherein said gap comprises a first gap formed from said oil supply passage toward a suction pipe and a second gap formed from said oil supply passage toward said compression chamber, and said second gap is greater than said first gap.

20. The scroll compressor according to claim 19, wherein HFC-based refrigerant or HCFC-based refrigerant is used as said refrigerant.

21. The scroll compressor according to claim 19, wherein carbon dioxide is used as said refrigerant.

22. The scroll compressor according to claim 15, wherein HFC-based refrigerant or HCFC-based refrigerant is used as said refrigerant.

23. The scroll compressor according to claim 15, wherein carbon dioxide is used as said refrigerant.

24. The scroll compressor according to claim 14, wherein at least one of ends constituting the side surface of said oil collision part on the side of a refrigerant passage is formed into a r-shape.

25. The scroll compressor according to claim 14, wherein HFC-based refrigerant or HCFC-based refrigerant is used as said refrigerant.

26. The scroll compressor according to claim 14, wherein carbon dioxide is used as said refrigerant.

* * * * *